US007378796B2

(12) United States Patent
Fujitani et al.

(10) Patent No.: US 7,378,796 B2
(45) Date of Patent: May 27, 2008

(54) PLASMA DISPLAY PANEL

(75) Inventors: Morio Fujitani, Osaka (JP); Keisuke Sumida, Osaka (JP); Tatsuo Mifune, Osaka (JP); Shinichiro Ishino, Shiga (JP); Hiroyuki Tachibana, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 14 days.

(21) Appl. No.: 10/559,262

(22) PCT Filed: Jun. 1, 2004

(86) PCT No.: PCT/JP2004/007895

§ 371 (c)(1),
(2), (4) Date: Dec. 2, 2005

(87) PCT Pub. No.: WO2004/109739

PCT Pub. Date: Dec. 16, 2004

(65) Prior Publication Data

US 2006/0113914 A1 Jun. 1, 2006

(30) Foreign Application Priority Data

Jun. 5, 2003 (JP) ..... 2003-160275

(51) Int. Cl.
*H01J 17/49* (2006.01)

(52) U.S. Cl. ..... 313/586; 313/585; 313/587

(58) Field of Classification Search ..... 313/582–587
See application file for complete search history.

(56) References Cited

U.S. PATENT DOCUMENTS 5,818,168 A * 10/1998 Ushifusa et al. ..... 313/582
6,313,580 B1 * 11/2001 Makino ..... 313/582
6,411,033 B1 * 6/2002 Mori et al. ..... 313/582
6,414,435 B1 * 7/2002 Akiba ..... 313/584
7,009,587 B2 * 3/2006 Nishimura et al. ..... 345/67
7,071,621 B1 * 7/2006 Namiki et al. ..... 313/584
7,112,922 B2 * 9/2006 Tachibana et al. ..... 313/582
2001/0020924 A1 9/2001 Makino
2002/0027417 A1 * 3/2002 Mori et al. ..... 313/582
2003/0076037 A1 * 4/2003 Choi ..... 313/582
2003/0173888 A1 * 9/2003 Ko et al. ..... 313/422
2004/0212303 A1 * 10/2004 Kao et al. ..... 313/582
2006/0279214 A1 * 12/2006 Fujitani et al. ..... 313/587

FOREIGN PATENT DOCUMENTS

JP 5-2992 1/1993
JP 05002992 A * 1/1993
JP 11-238463 8/1999
JP 11-297211 10/1999
JP 2001-195990 7/2001
JP 2002-297091 10/2002

* cited by examiner

*Primary Examiner*—Nimeshkumar D. Patel
*Assistant Examiner*—Anne M Hines
(74) *Attorney, Agent, or Firm*—Wenderoth, Lind & Ponack, L.L.P.

(57) ABSTRACT

A plasma display panel has a stable addressing characteristic, no dielectric breakdown, and high reliability. Data electrodes (10), first dielectric layer (17) for covering the data electrodes (10), priming electrodes (15), and second dielectric layer (18) for covering the priming electrodes (15) are sequentially formed on back substrate (2). Slotted parts (10*a*) are formed in a part of each data electrode (10). Thus, data electrodes (10) are prevented from deforming during the manufacturing, and dielectric voltage between data electrodes (10) and priming electrodes (15) is improved.

3 Claims, 8 Drawing Sheets

PLASMA DISPLAY PANEL

This application is a U.S. national phase application of PCT international application PCT/JP2004/007895.

TECHNICAL FIELD

The present invention relates to a plasma display panel used in a wall-hanging television or a large monitor.

BACKGROUND ART

An alternating-current surface discharge type plasma display panel (hereinafter referred to as "PDP") typical as an alternating-current (AC) type plasma display panel has the following configuration. The configuration has a front substrate formed of a glass substrate that performs surface discharge and is formed by arranging scan electrodes and sustain electrodes, and a back substrate formed of a glass substrate having data electrodes. The front substrate and the back substrate are arranged so as to face each other in parallel so that the scan electrodes and sustain electrodes form a matrix in combination with the data electrodes and a discharge space is formed in a clearance. The outer peripheries of the front substrate and back substrate are sealed by a sealant such as glass frit. Discharge cells partitioned by barrier ribs are disposed between the substrates, and phosphor layers are formed in cell spaces between the barrier ribs. The PDP having such a configuration generates an ultraviolet ray with gas discharge, and emits light by exciting phosphor of each color with the ultraviolet ray, thereby performing color display.

The PDP divides one field time period into a plurality of subfields, and is driven by a combination of the subfields at which light is emitted, thereby performing gradation display. Each subfield is formed of an initialization time period, an addressing time period, and a sustaining time period. For displaying image data, different signal waveforms are applied to each electrode in the initialization time period, the addressing time period, and the sustaining time period, respectively.

In the initialization time period, for example, positive pulse voltage is applied to all scan electrodes, and a required wall charge is accumulated on a protective film and the phosphor layer. The protective film is disposed on a dielectric layer for covering the scan electrodes and the sustain electrodes.

In the addressing time period, negative scan pulses are sequentially applied to all scan electrodes to perform scan. When the positive data pulses are applied to the data electrodes during scan of the scan electrodes in a case having display data, discharge occurs between the scan electrodes and the data electrodes, and a wall charge is formed on the protective film on the scan electrodes.

In the subsequent sustaining time period, a voltage sufficient for keeping the discharge between the scan electrodes and the sustain electrodes is applied for a certain period. Thus, discharge plasma is generated between the scan electrodes and the sustain electrodes, and the phosphor layer is excited to emit light for a certain period. In the discharge space where the data pulse is not applied in the addressing time period, the discharge does not occur and excitation or light emission does not occur in the phosphor layer.

Such a PDP has a problem where a long delay occurs in the discharge in the addressing time period and the addressing operation becomes unstable, or a problem where the addressing time is set to be long for perfectly performing the addressing operation and the time required for the addressing time period excessively increases. For handling these problems, PDPs where an auxiliary discharge electrode is disposed on the front substrate and a priming discharge caused by the in-plane auxiliary discharge on the front substrate side reduces the discharge delay, and driving methods of the PDPs are disclosed in Japanese Patent Unexamined Publication No. 2001-195990 and Japanese Patent Unexamined Publication No. 2002-297091, for example.

When the definition is improved and the number of lines is increased in these PDPs, however, the time required for the addressing time period further increases, hence the time required for the sustaining time period must be decreased, and the luminance is hardly secured at high definition, disadvantageously. Also when xenon (Xe) partial pressure is increased for achieving high luminance and high efficiency, the discharge starting voltage increases, the discharge delay increases, and the addressing characteristic degrades, disadvantageously. The addressing characteristic is largely affected by the process, decease of the discharge delay in addressing and reduction of the addressing time are required.

There are the following problems associated with the requirement. In other words, the conventional PDP that performs the priming discharge in the front substrate cannot sufficiently reduce the discharge delay in addressing, has a small operation margin in the auxiliary discharge, or causes false discharge to destabilize the operation, disadvantageously. The auxiliary discharge is formed in the plane of the front substrate, so that priming particles more than required for priming are supplied to an adjacent discharge cell, and crosstalk occurs.

The present invention addresses the above-mentioned problems, and provides a PDP that can reduce the discharge delay in addressing and stabilize the discharge characteristic, and has high reliability.

SUMMARY OF THE INVENTION

A PDP of the present invention has the following elements:

- a first electrode and a second electrode that are disposed in parallel on a first substrate;
- a third electrode disposed in the direction orthogonal to the first electrode and the second electrode and on a second substrate facing the first substrate through a discharge space;
- a fourth electrode disposed on the second substrate, in parallel with the first electrode and second electrode, and closer to the first electrode and second electrode than the third electrode;
- a plurality of main discharge cells formed of the first electrode, second electrode, and third electrode; and
- a barrier rib formed on the second substrate so as to partition a plurality of priming discharge cells formed of the fourth electrode and one of the first electrode and second electrode.

The third electrode is covered with a first dielectric layer, the fourth electrode is disposed on the first dielectric layer, and the third electrode has a slotted part.

This configuration can realize a PDP where the discharge characteristic is stabilized by certainly performing the priming discharge that can reduce the discharge delay in addressing. This configuration can also realize a PDP where dielectric breakdown does not occur between the third electrode and the fourth electrode and has high reliability.

DETAILED DESCRIPTION OF PREFERRED EMBODIMENTS

A PDP in accordance with an exemplary embodiment of the present invention will be described hereinafter with reference to the following drawings.

First Exemplary Embodiment

Figure 1:
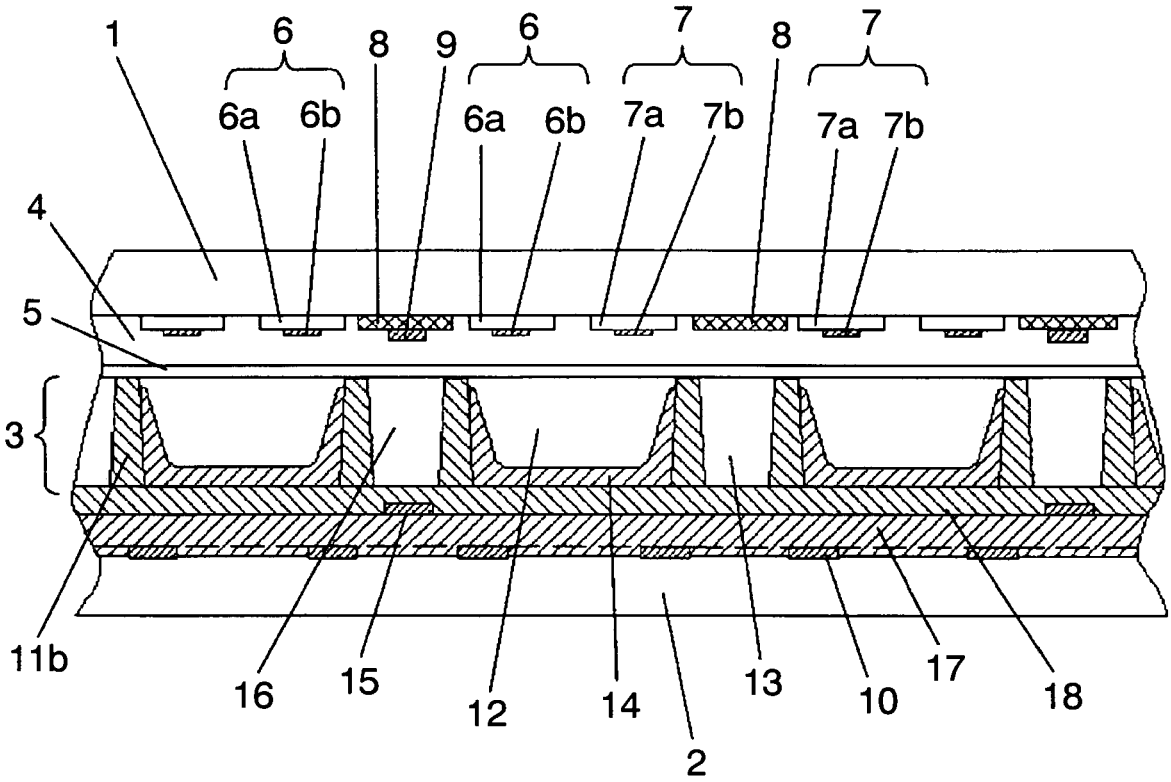
FIG. 1 is a sectional view showing a PDP in accordance with an exemplary embodiment of the present invention.
Figure 2:
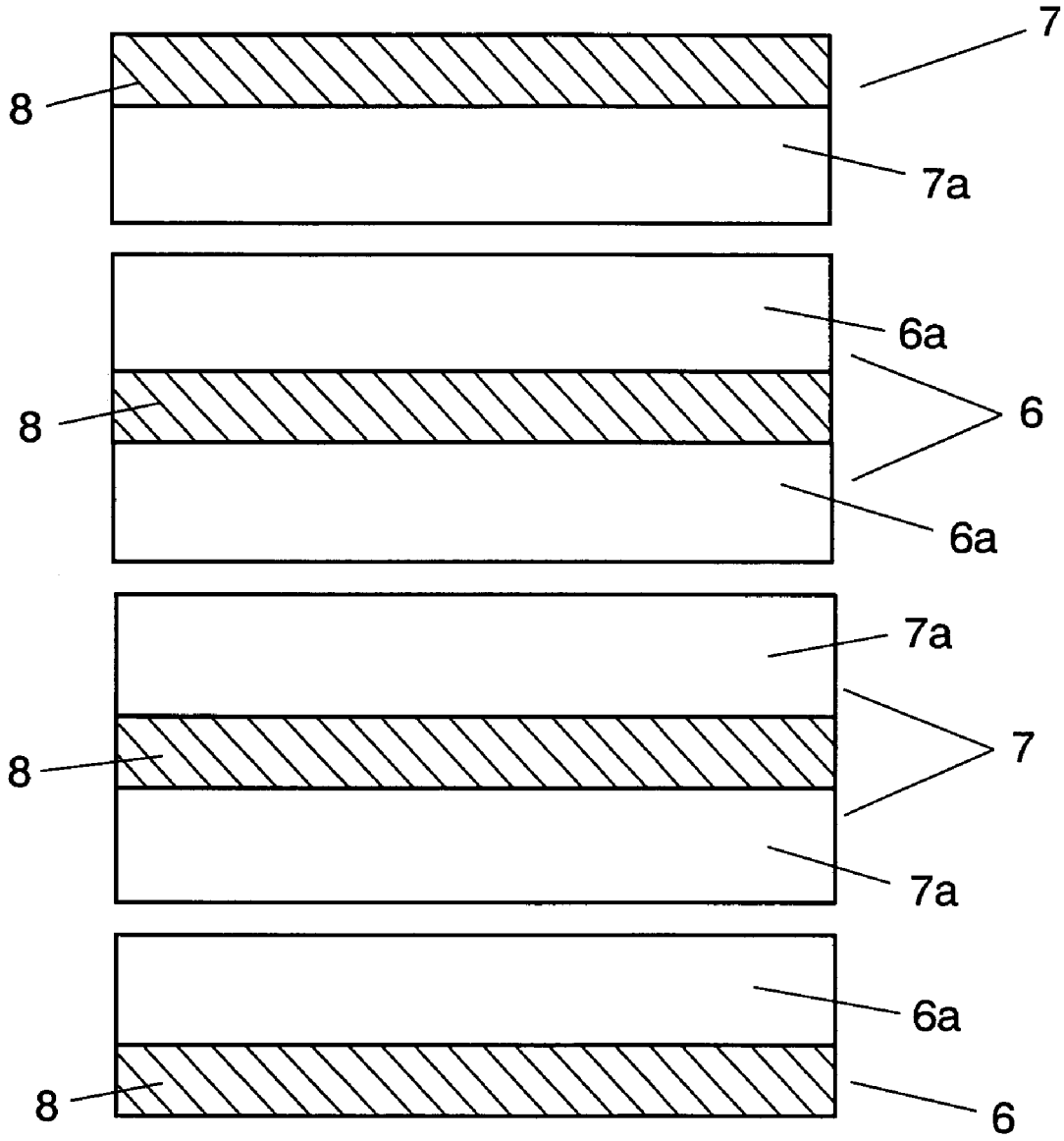
FIG. 2 is a schematic plan view of an electrode array on a front substrate side of the PDP.
Figure 3:
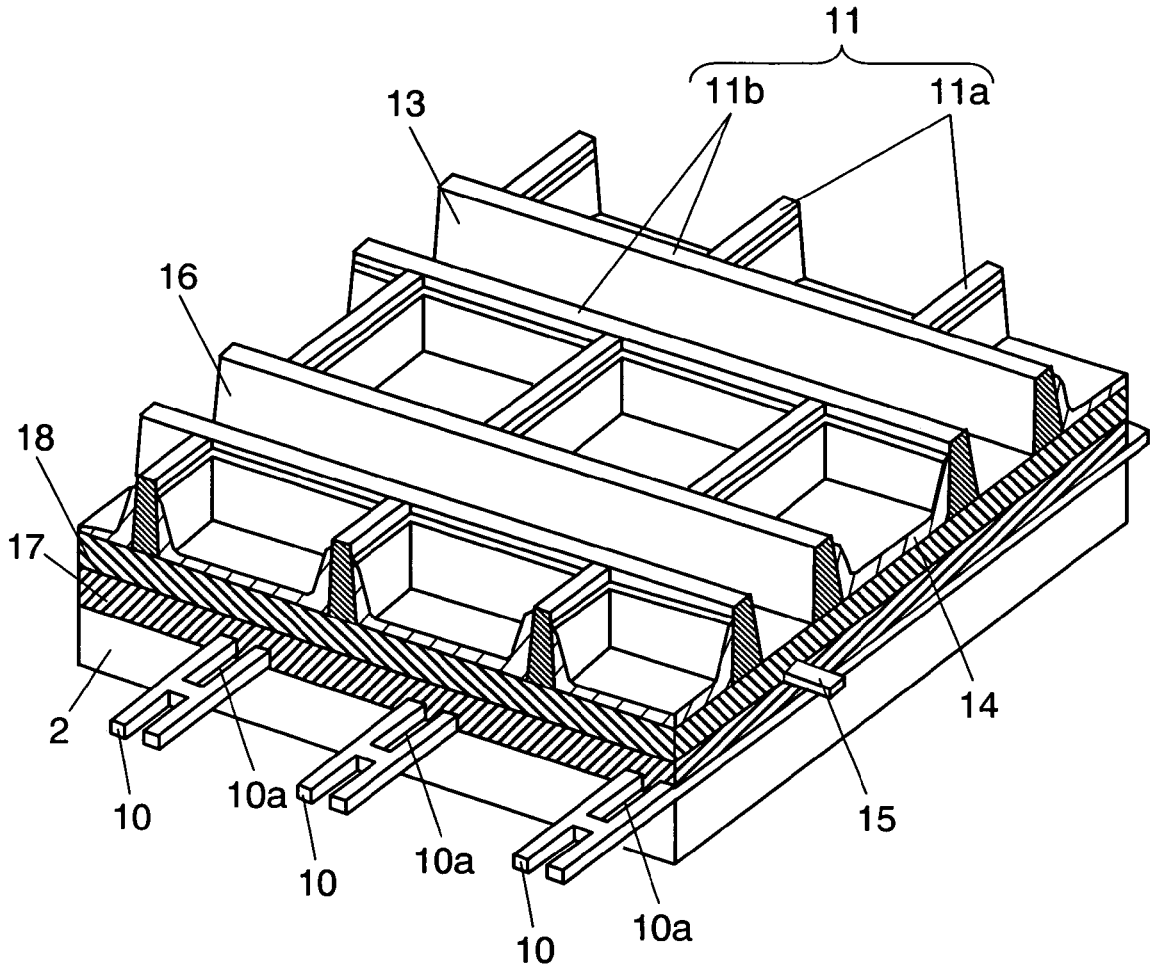
FIG. 3 is a schematic perspective view of a back substrate side of the PDP.

FIG. 1 is a sectional view showing a PDP in accordance with an exemplary embodiment of the present invention. FIG. 2 is a schematic plan view of an electrode array on the side of a front substrate as a first substrate. FIG. 3 is a schematic perspective view of the side of a back substrate as a second substrate.

As shown in FIG. 1, glass-made front substrate 1 as the first substrate and glass-made back substrate 2 as the second substrate are arranged so as to face each other across discharge space 3, and neon (Ne) and xenon (Xe) as gas that emits ultraviolet rays by discharge are filled into discharge space 3. Band-like electrode groups are disposed in parallel on front substrate 1. Each of the electrode groups is covered with front substrate dielectric layer 4 and protective film 5 and has a pair of scan electrode 6 as a first electrode and sustain electrode 7 as a second electrode. Scan electrode 6 and sustain electrode 7 are formed of transparent electrodes 6*a* and 7*a* and metal buses 6*b* and 7*b*. Metal buses 6*b* and 7*b* are formed so as to overlie transparent electrodes 6*a* and 7*a* and are made of silver (Ag) or the like for improving conductivity. As shown in FIG. 1 and FIG. 2, scan electrodes 6 and sustain electrodes 7 are arranged alternately by two, namely in the order of scan electrode 6-scan electrode 6-sustain electrode 7-sustain electrode 7 and so on. Light absorbing layers 8 for improving contrast in light emission are disposed between two adjacent scan electrodes 6 and between two adjacent sustain electrodes 7. Auxiliary electrode 9 is disposed on light absorbing layer 8 between two adjacent scan electrodes 6, and is connected to one of the adjacent scan electrodes 6 in a non-display part (end) of the PDP.

Figure 6:
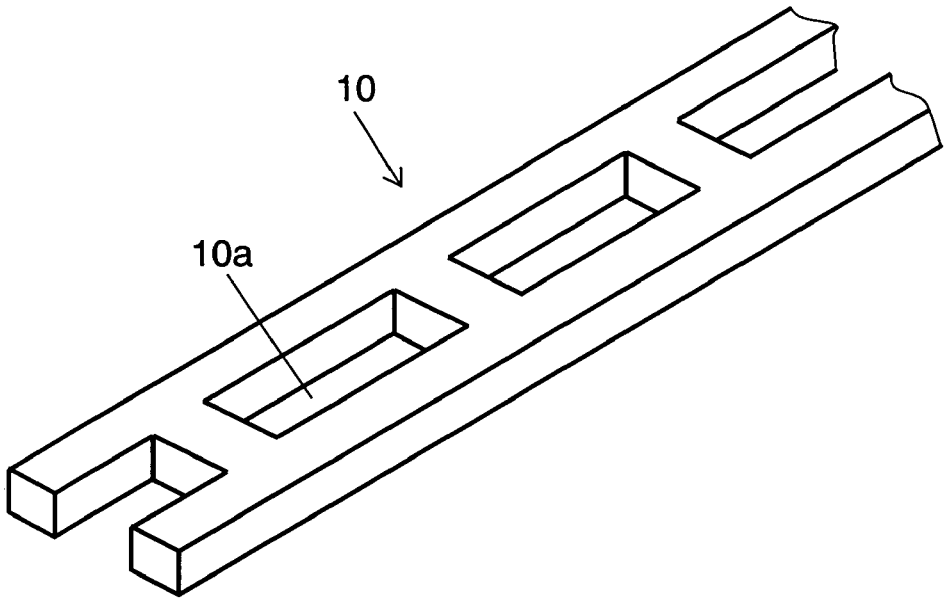
FIG. 6 is a perspective view showing a shape of a data electrode in accordance with the first exemplary embodiment of the present invention.

As shown in FIG. 1 and FIG. 3, a plurality of band-like data electrodes 10 as third electrodes are disposed on back substrate 2, in parallel with each other, and in the direction orthogonal to scan electrodes 6 and sustain electrodes 7. Each data electrode 10 has slotted parts 10*a* as shown in FIG. 3 and FIG. 6. First dielectric layer 17 is formed on back substrate 2 so as to cover data electrodes 10. Priming electrodes 15 as the fourth electrodes are formed in parallel with auxiliary electrodes 9, at positions corresponding to auxiliary electrodes 9 disposed on front surface 1, and on first dielectric layer 17. Second dielectric layer 18 is formed on first dielectric layer 17 so as to cover priming electrodes 15. Barrier ribs 11 for partitioning a plurality of discharge cells formed of scan electrodes 6, sustain electrodes 7, and data electrodes 10 are formed on second dielectric layer 18. Each barrier rib 11 has the following elements:

- longitudinal wall part 11*a* extending in the direction orthogonal to scan electrodes 6 and sustain electrodes 7 that are disposed on front surface 1, namely in the direction parallel with data electrodes 10; and
- lateral wall part 11*b* that is orthogonal to longitudinal wall part 11*a*, forms main discharge cells 12, and forms clearances 13 partially defining a priming electrode cell between main discharge cells 12.

Phosphor layers 14 are formed on main discharge cells 12.

In FIG. 3, clearances 13 on back substrate 2 are continuously formed in the direction orthogonal to data electrodes 10, and form priming discharge cells 16. In each priming discharge cell 16, data electrodes 10 are covered with first dielectric layer 17, priming electrode 15 is formed on first dielectric layer 17, and second dielectric layer 18 is formed on priming electrode 15. Priming electrode 15 is closer to protective film 5 of front substrate 1 than data electrodes 10, and hence has a discharge distance that is shorter than that between front substrate 1 of main discharge cell 12 and data electrode 10 by a thickness of first dielectric layer 17.

Figure 4:
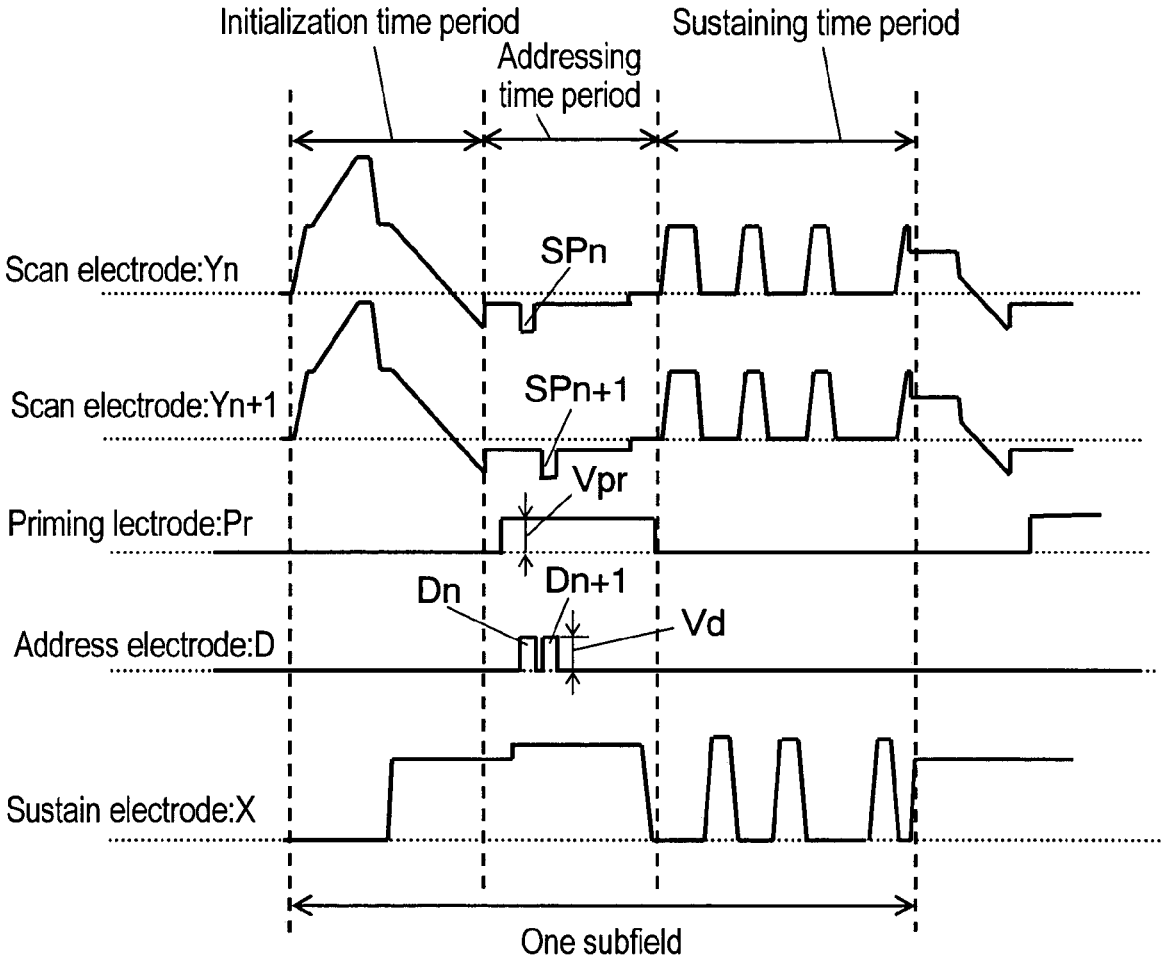
FIG. 4 is a waveform diagram showing one example of a driving waveform for driving the PDP.

Next, a method of displaying image data on the PDP is described. In a driving method of the PDP, one field period is divided into a plurality of subfields having a weight of light emitting period in binary notation, and gradation display is performed by a combination of the subfields for emitting light. Each subfield is formed of an initialization time period, an addressing time period, and a sustaining time period. FIG. 4 is a waveform diagram showing one example of a driving waveform for driving the PDP of the present embodiment of the present invention. Firstly, in the initialization time period, in the priming discharge cell (priming discharge cell 16 in FIG. 1) having priming electrode Pr (priming electrode 15 in FIG. 1), a positive pulse voltage is applied to all scan electrodes Y (scan electrodes 6 in FIG. 1), and the initialization is performed between the auxiliary electrode (auxiliary electrode 9 in FIG. 1) and priming electrode Pr. In the subsequent addressing time period, a positive voltage is always applied to priming electrode Pr. Thus, when scan pulse $SP_n$ is applied to scan electrode $Y_n$ in the priming discharge cell, priming discharge occurs between priming electrode Pr and the auxiliary electrode, and priming particles are supplied to the main discharge cell (main discharge cell 12 in FIG. 1). Next, scan pulse $SP_{n+1}$ is applied to scan electrode $Y_{n+1}$ in the n+1-th main discharge cell. Since the priming discharge occurs just before the application, the priming particles are already supplied and hence the discharge delay in the next addressing time can be reduced. Only a driving sequence of one field has been described; however, the operation principle in the other subfield is similar. In the driving waveform shown in FIG.

4, a positive voltage is applied to priming electrode Pr in the addressing time period, thereby certainly causing the above-mentioned operation. The applied voltage to priming electrode Pr in the addressing time period is preferably set larger than a data voltage value applied to data electrode D (data electrode 10 in FIG. 1).

In this configuration, each priming electrode 15 is formed on first dielectric layer 17 in each priming discharge cell 16. Therefore, when first dielectric layer 17 is appropriately formed, the dielectric voltage between data electrode 10 and priming electrode 15 can be secured by first dielectric layer 17. The priming discharge and address discharge can be stably generated. First dielectric layer 17 disposed in priming discharge cell 16 makes the height of the discharge space of priming discharge cell 16 lower than the height of the discharge space of main discharge cell 12. Thus, priming discharge in main discharge cell 12 corresponding to scan electrode 6 connected to auxiliary electrode 9 can be stably generated before the address discharge in main discharge cell 12, and the discharge delay in main discharge cell 12 can be reduced.

Figure 5:
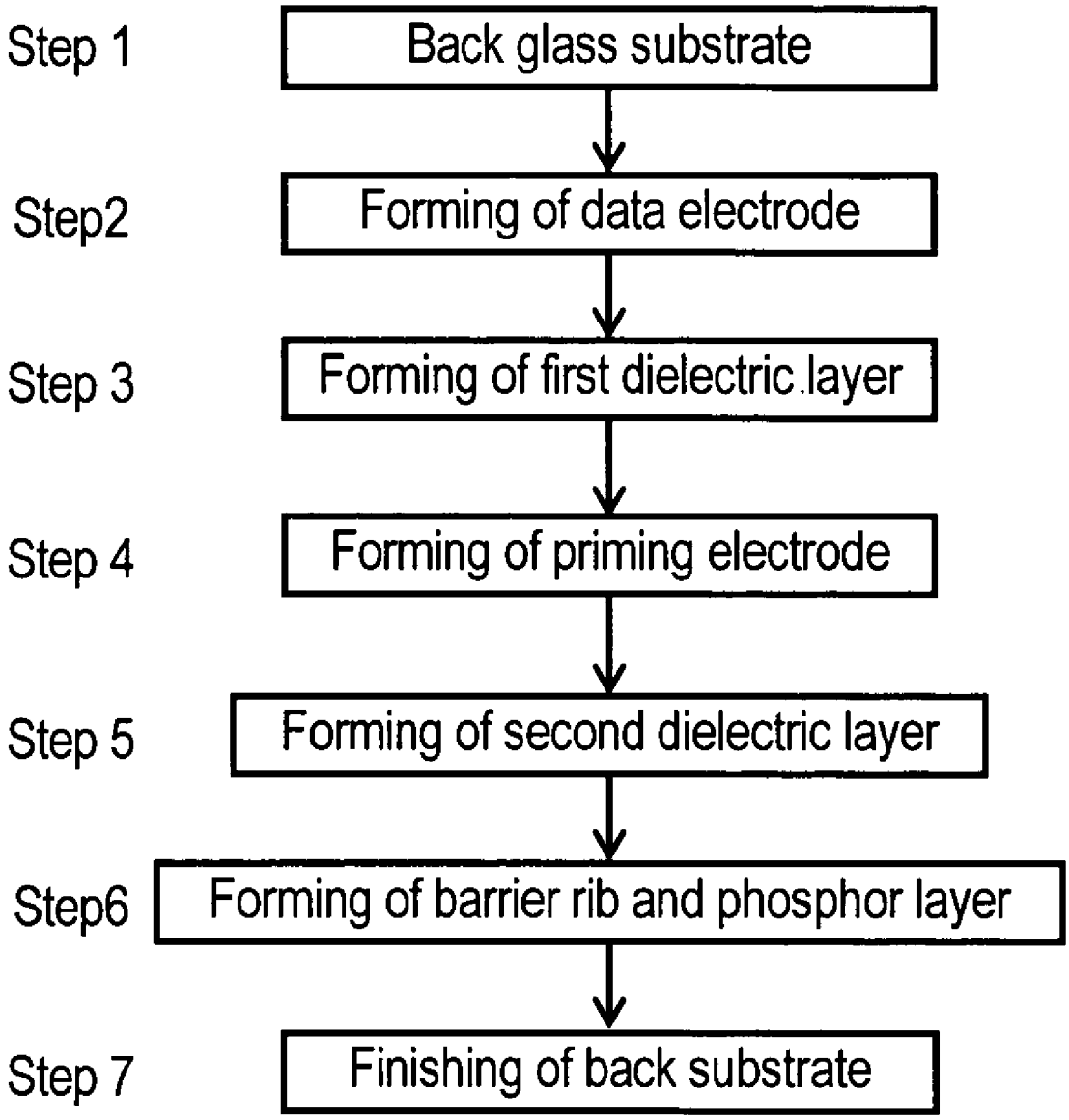
FIG. 5 is a flow diagram of a manufacturing process of the back substrate of the PDP.

FIG. 5 is a flow diagram of a manufacturing process of the back substrate of the PDP in accordance with the present embodiment of the present invention. The manufacturing process of the back substrate of the PDP is described hereinafter with reference to FIG. 5.

A back glass substrate as back substrate 2 is prepared in step 1. Next, data electrodes 10 are formed in step 2. Silver (Ag) paste is applied to data electrodes 10, and the silver (Ag) line is then formed by a photo-lithograph method. After that, data electrodes 10 are burned to be solidified and formed. Each data electrode 10 has square holes as slotted parts 10*a* as shown in FIG. 3 and FIG. 6, and has a ladder shape. Forming data electrode 10 in the ladder shape can release an air bubble generated during the burning of data electrode 10 from the square holes (slotted parts 10*a*), so that the air bubble can be prevented from deforming data electrode 10. Side surface parts of slotted parts 10*a* are formed to increase the area for releasing the air bubble, and the deformation of data electrode 10 can be effectively prevented.

Figure 9:
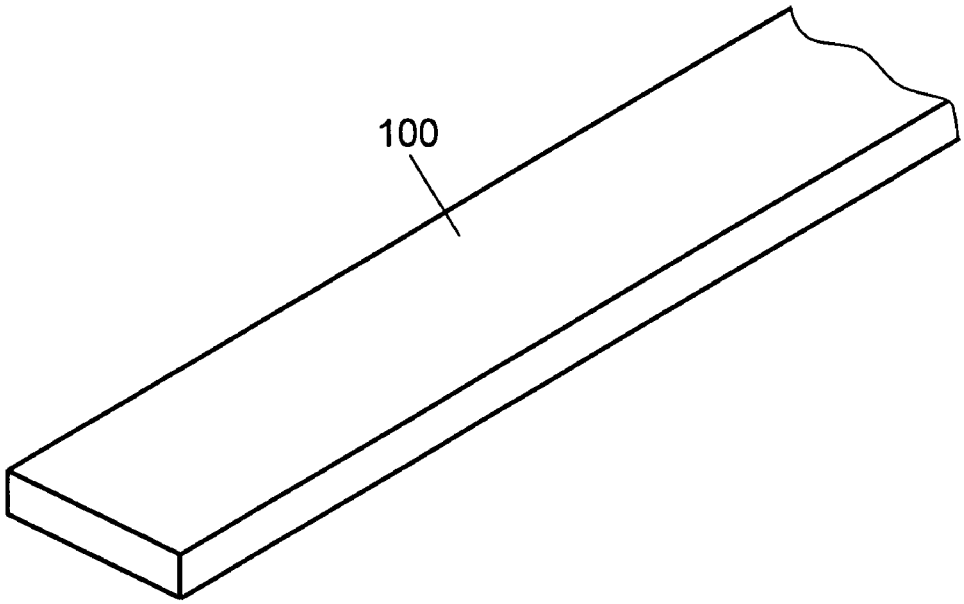
FIG. 9 PRIOR ART
FIG. 9 is a perspective view showing a shape of a conventional data electrode.
Figure 10:
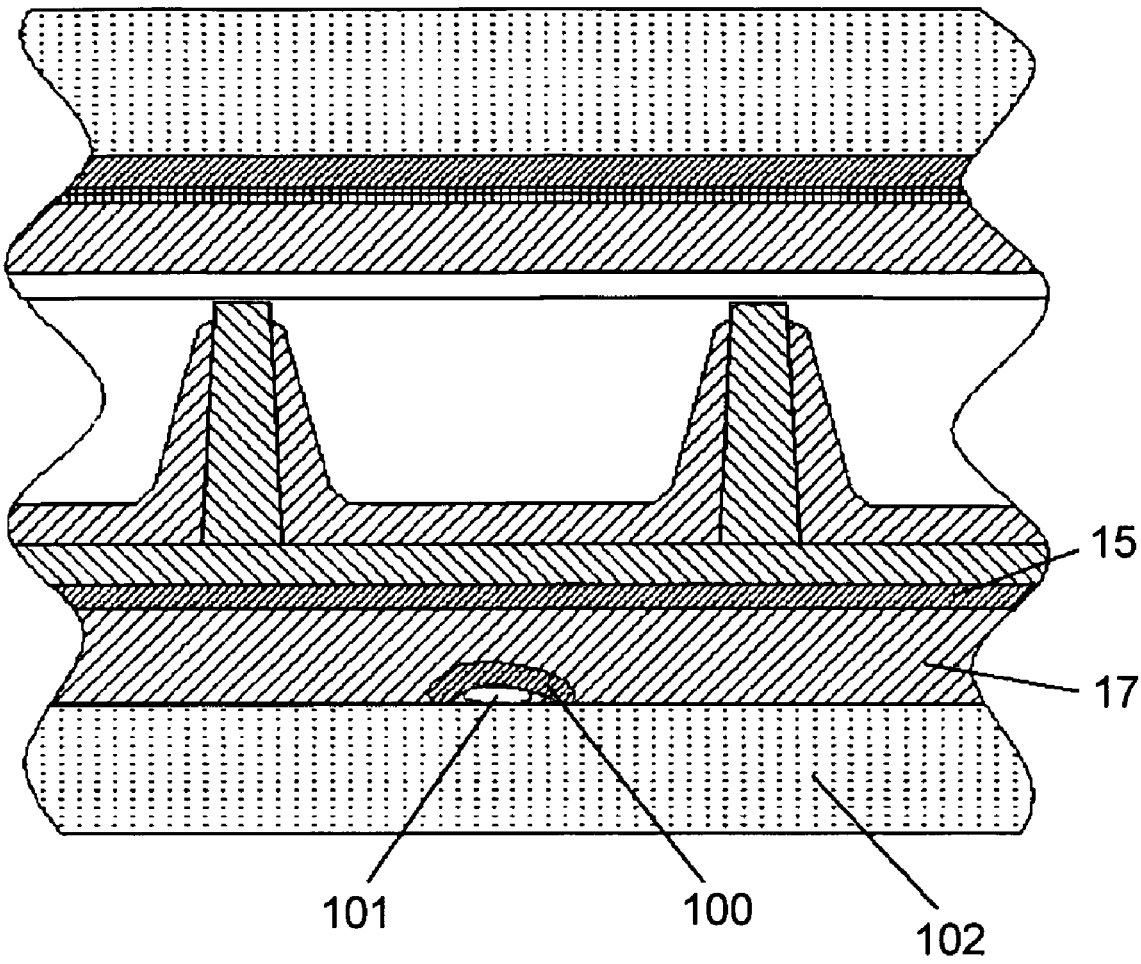
FIG. 10 PRIOR ART
FIG. 10 is a sectional view of a PDP using the conventional data electrode.

FIG. 9 is a perspective view showing a shape of conventional data electrode 100. FIG. 10 is a sectional view of a PDP using the data electrode 100. When data electrode 100 has a strip shape as shown in FIG. 9, namely a plane shape in the longitudinal direction of the electrode, there are the following problems. A foreign matter or organic matter existing between data electrode 100 and back glass substrate 102 generates an air bubble in a burning process of data electrode 100. Since data electrode 100 is planar, the air bubble cannot separate upward and hence the air bubble presses up data electrode 100. Therefore, data electrode 100 is pressed by air bubble 101 so as to be deformed as shown in FIG. 10, and an insulation distance between data electrode 100 and priming electrode 15 cannot always be maintained.

However, in embodiment 1 of the present invention shown in FIG. 6, the generated air bubble separates upward through the square holes of slotted parts 10*a* formed in the longitudinal direction of data electrode 10, and data electrode 10 does not deform during burning. The distance between data electrode 10 and priming electrode 15 can therefore be kept suitable, the cause of the dielectric breakdown is removed, and a PDP having high reliability can be realized. Since data electrode 10 is formed in the ladder shape as shown in FIG. 6, the whole conduction in the longitudinal direction can be secured even when the electrode part is partially disconnected, and a PDP having high reliability can be realized.

Next, first dielectric layer 17 is formed in step 3. As the material of first dielectric layer 17, a $ZnO—B_2O_3—SiO_2$ based mixture, a $PbO—B_2O_3—SiO_2$ based mixture, a $PbO—B_2O_3—SiO_2—Al_2O_3$ based mixture, a $PbO—ZnO—B_2O_3—SiO_2$ based mixture, or a $Bi_2O_3—B_2O_3—SiO_2$ based mixture is used. In the present embodiment, the $PbO—B_2O_3—SiO_2$ based mixture having the composition of PbO: 65 to 70 wt %, $B_2O_3$: 5 wt %, and $SiO_2$: 25 to 30 wt % is used. The material of first dielectric layer 17 is deformed to a paste form, and is applied to data electrode 10. The applying method is not especially limited, and a publicly known applying and printing method can be used. For example, a roll coating method, a slit die coating method, a doctor blade method, a screen printing method, and an offset printing method are used. In the present embodiment, the applying thickness of the paste of first dielectric layer 17 depends on the content of inorganic components in the paste, but is preferably 5 to 40 μm. By setting the applying thickness of the paste of first dielectric layer 17 at 5 μm or thicker, the unevenness of the electrode layer after burning can be moderated. Then, the paste of first dielectric layer 17 is burned and solidified.

Next, priming electrodes 15 are formed in step 4. The forming method thereof is substantially similar to that of data electrodes 10 in step 2, and silver (Ag) paste is burned.

Next, second dielectric layer 18 is formed in step 5. The forming method thereof is substantially similar to that of first dielectric layer 17 in step 3. In a method similar to the forming method of first dielectric layer 17, burning and solidification are performed after application.

Next, barrier ribs 11 and phosphor layers 14 are formed in step 6. Photosensitive paste that contains glass components and photosensitive organic components is applied and dried, and then a pattern of longitudinal wall parts 11*a* and lateral wall parts 11*b* is formed using a photo process or the like. Here, wall parts 11*a* and 11*b* form the spaces of main discharge cells 12, the spaces of priming discharge cells 16, and the spaces of clearances 13. Phosphor layers 14 of R, G and B are applied and filled into main discharge cells 12. Barrier ribs 11 and phosphor layers 14 are simultaneously burned and solidified, thereby forming final barrier ribs 11 and phosphor layer s14.

Back substrate 2 is finished by the above-mentioned processes (step 7).

Second Exemplary Embodiment

Figure 7:
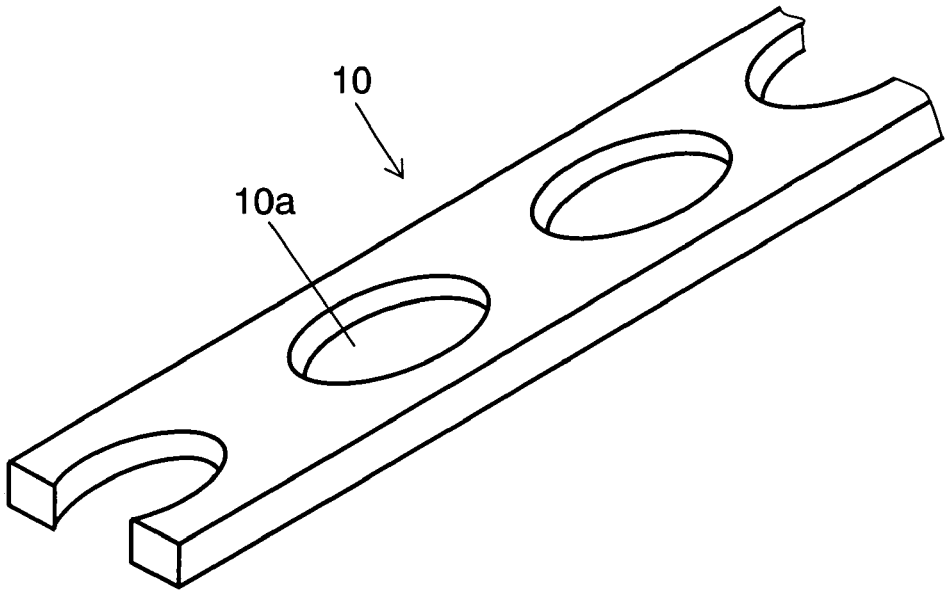
FIG. 7 is a perspective view showing a shape of a data electrode in accordance with the second exemplary embodiment of the present invention.

FIG. 7 is a perspective view showing a shape of data electrode 10 in accordance with the second exemplary embodiment of the present invention. In the second exemplary embodiment, slotted parts 10*a* in data electrode 10 are circular or elliptic holes. The configuration except for slotted parts 10*a* is similar to that of embodiment 1.

Forming slotted parts 10*a* in data electrode 10 as the circular or elliptic holes produces the following advantage. In other words, though space for releasing the air bubble is narrower than that in the case using square holes, stress concentration can be suppressed because the holes of slotted parts 10*a* have no sharp edge, and torsion or chamber due to heating can be reduced. As a result, a PDP having high reliability and no cause of dielectric breakdown in addition to the advantage described in embodiment 1 can be realized.

Third Exemplary Embodiment

Figure 8:
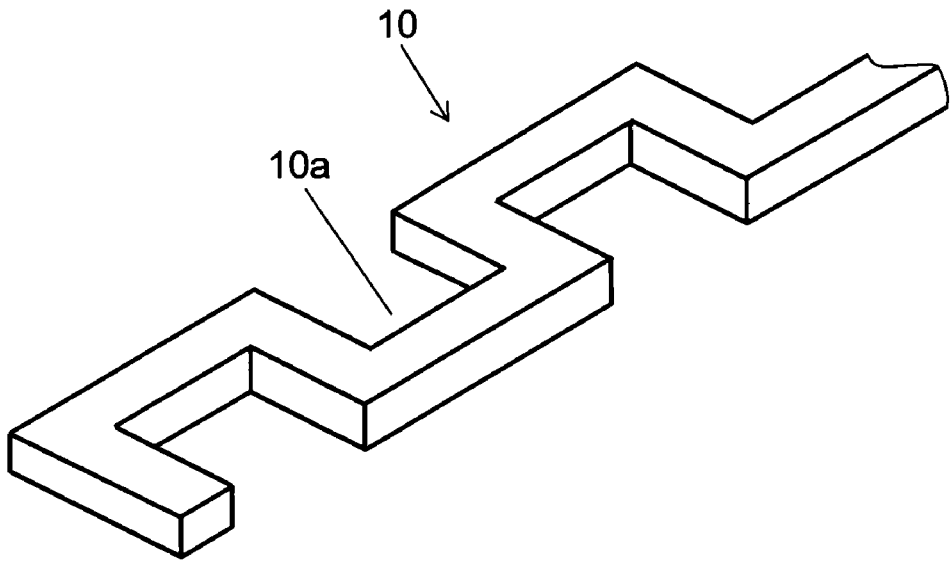
FIG. 8 is a perspective view showing a shape of a data electrode in accordance with the third exemplary embodiment of the present invention.

FIG. 8 is a perspective view showing a shape of data electrode 10 in accordance with the third exemplary embodiment of the present invention. In the third exemplary embodiment, slotted parts 10*a* in data electrode 10 have a shape where side parts are alternately notched in the longitudinal direction of data electrode 10. The configuration except for slotted parts 10*a* is similar to that of embodiment 1. Forming slotted parts 10*a* in this shape allows the hole area, namely the space for releasing the air bubble, to be enlarged, and largely suppresses the deformation of data electrode 10 due to the air bubble. A PDP having high reliability and no cause of dielectric breakdown can be realized.

In the manufacturing processes of exemplary embodiments 1 to 3 of the present invention, data electrodes 10, first dielectric layer 17, priming electrodes 15, second dielectric layer 18, barrier ribs 11, and phosphor layers 14 are sequentially applied, burned, and solidified. However, for simplifying the processes, the layers may be burned and solidified in a lump after sequential application. In this case, the air bubble generated from data electrodes 10 disposed in the lowest layer must be further sufficiently released. However, in the exemplary embodiments of the present invention, the air bubble can be further effectively released, hence the shape of data electrodes 10 can be stabilized, and the dielectric voltage can be improved.

In the exemplary embodiments of the present invention, slotted parts 10*a* are disposed in each data electrode 10 on back substrate 2 to prevent the deformation of data electrode 10 during burning. However, this method can be used when metal buses 6*b* and 7*b* are formed on front substrate 1. In other words, slotted parts are disposed in metal buses 6*b* and 7*b* to prevent the deformation thereof during burning, thereby improving the withstanding voltage characteristic by dielectric layer 4 on the front substrate.

INDUSTRIAL APPLICABILITY

The present invention can provide a PDP where certain priming discharge is allowed, dielectric voltage between the data electrode and the priming electrode is secured, and reliability is high. The PDP is therefore used in a large-screen display device or the like.

The invention claimed is:

1. A plasma display panel comprising:

a first substrate and a second substrate, the second substrate being arranged so as to face the first substrate across a discharge space;

a plurality of first electrodes and a plurality of second electrodes that are disposed in parallel on the first substrate;

a plurality of third electrodes arranged on the second substrate so as to be disposed in a direction orthogonal to the pluralities of first and second electrodes;

a plurality of fourth electrodes disposed on the second substrate so as to be in parallel with the pluralities of first and second electrodes, and such that a distance between the plurality of fourth electrodes and the pluralities of first and second electrodes is less than a distance between the plurality of third electrodes and the pluralities of first and second electrodes;

a plurality of auxiliary electrodes, each of the auxiliary electrodes being connected to any one of the first and second electrodes so as to be parallel with the plurality of fourth electrodes;

a plurality of barrier ribs formed on the second substrate;

a plurality of main discharge cells partitioned by the plurality of barrier ribs such that each of the main discharge cells corresponds to one of the first electrodes, one of the second electrodes, and one of the third electrodes; and a plurality of priming discharge cells partitioned by the plurality of barrier ribs such that each of the priming discharge cells corresponds to one of the fourth electrodes and either one of the first electrodes or one of the auxiliary electrodes, wherein in an initialization time period, positive pulse voltage is applied to the first electrodes so as to perform initialization between the auxiliary electrodes and the fourth electrodes, and in a subsequent addressing time period, positive voltage is applied to the fourth electrodes, wherein the plurality of third electrodes is covered with a first dielectric layer, the plurality of fourth electrodes is disposed on the first dielectric layer, and each of the third electrodes has a plurality of circular or elliptical shaped slotted parts in a longitudinal direction of the third electrodes.

2. The plasma display panel according to claim 1, wherein each of the third electrodes has a ladder shape.

3. The plasma display panel according to claim 1, wherein the auxiliary electrodes are disposed on the first substrate, the fourth electrodes are arranged on the first dielectric layer so as to be parallel to the auxiliary electrodes, and the fourth electrodes are arranged at positions corresponding to the auxiliary electrodes, respectively.

* * * * *